US011244601B2

(12) United States Patent
Park

(10) Patent No.: US 11,244,601 B2
(45) Date of Patent: Feb. 8, 2022

(54) DISPLAY DEVICE AND METHOD OF DRIVING THE SAME

(71) Applicant: SAMSUNG DISPLAY CO., LTD., Yongin-si (KR)

(72) Inventor: Jun Hyun Park, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/909,250

(22) Filed: Jun. 23, 2020

(65) Prior Publication Data

US 2021/0125544 A1 Apr. 29, 2021

(30) Foreign Application Priority Data

Oct. 23, 2019 (KR) ..... 10-2019-0132507

(51) Int. Cl.
*G09G 3/32* (2016.01)
*G09G 3/3258* (2016.01)

(52) U.S. Cl.
CPC ..... *G09G 3/32* (2013.01); *G09G 3/3258* (2013.01); *G09G 2300/0871* (2013.01); *G09G 2310/06* (2013.01); *G09G 2320/04* (2013.01); *G09G 2330/028* (2013.01)

(58) Field of Classification Search
CPC ... G09G 3/32–3291; G09G 2300/0871; G09G 2310/06; G09G 2330/028
See application file for complete search history.

(56) References Cited

U.S. PATENT DOCUMENTS 8,462,089 B2 * 6/2013 Han ..... G09G 3/3283 345/82
8,614,657 B2 * 12/2013 Han ..... G09G 3/3233 345/77
8,704,738 B2 * 4/2014 Han ..... G09G 3/3283 345/82
10,540,927 B2 * 1/2020 Park ..... G09G 3/3233
10,839,757 B2 * 11/2020 Park ..... G09G 3/3291
2011/0273428 A1 * 11/2011 Han ..... G09G 3/3283 345/212
2011/0279484 A1 * 11/2011 Han ..... G09G 3/3233 345/690

(Continued)

FOREIGN PATENT DOCUMENTS

KR 1020180093147 A 8/2018
KR 1020190012303 A 2/2019

*Primary Examiner* — Gene W Lee
(74) *Attorney, Agent, or Firm* — Cantor Colburn LLP

(57) ABSTRACT

A display device includes pixels, each including a first transistor including a gate electrode, a first electrode, and a second electrode coupled to a first node, a first power line, and a second node, respectively, a second transistor including a gate electrode, a first electrode, and a second electrode coupled to a scan line, the first node, and a third node, respectively, a third transistor including a gate electrode, a first electrode, and a second electrode coupled to a control line, the third node, and the second node, respectively, a first capacitor including first and second electrodes coupled to the first node and an initialization line, respectively, a second capacitor including first and second electrodes coupled to the third node and a data line, respectively, and a light-emitting diode including an anode and a cathode coupled to the second node and a second power line.

18 Claims, 11 Drawing Sheets

(56) References Cited

U.S. PATENT DOCUMENTS

| | | | | |
|---|---|---|---|---|
| 2018/0053470 | A1* | 2/2018 | Morita | G09G 3/3258 |
| 2018/0226028 | A1 | 8/2018 | Park et al. | |
| 2019/0035336 | A1 | 1/2019 | Park et al. | |

* cited by examiner

DISPLAY DEVICE AND METHOD OF DRIVING THE SAME

The application claims priority to Korean patent application number 10-2019-0132507, filed on Oct. 23, 2019, and all the benefits accruing therefrom under 35 U.S.C. § 119, the content of which in its entirety is herein incorporated by reference.

BACKGROUND

1. Field

Various exemplary embodiments of the invention relate to a display device and a method of driving the display device.

2. Description of the Related Art

With a development of information technology, an importance of a display device, which is a connecting medium between information and users, is being emphasized. Accordingly, a use of display devices, such as liquid crystal display devices, organic light-emitting display devices, plasma display devices, and the like, is increasing.

A display device includes a plurality of pixels, and may display an image using a combination of light emission by the plurality of pixels. However, an increase in the scale or resolution of a display device causes resistance and capacitance to increase, whereby the level of a power voltage to be transmitted to the pixels drops, which is referred to as a voltage ("IR") drop problem.

Accordingly, in a case of a large-scale or high-resolution display device, it is necessary to supply a higher level of power voltage in consideration of the degree of the power voltage decreased due to the IR drop.

Accordingly, peripheral control circuits for supplying control signals to the pixels (e.g., a scan driver) are also desired to supply a high-level control signal in order to ensure the operation of transistors.

SUMMARY

When control circuits continuously supply high-level control signals, voltage stress may cause a reliability problem (e.g., a lifespan problem).

Various exemplary embodiments of the invention are directed to a display device and a method of driving the display device that may simultaneously solve both a voltage ("IR") drop problem and a reliability problem with control circuits.

An exemplary embodiment of the invention provides a display device. The display device includes a plurality of pixels, and each of the plurality of pixels includes a first transistor including the gate electrode coupled to a first node, the first electrode coupled to a first power line, and the second electrode coupled to a second node, a second transistor including the gate electrode coupled to a scan line, the first electrode coupled to the first node, and the second electrode coupled to a third node, a third transistor including the gate electrode coupled to a control line, the first electrode coupled to the third node, and the second electrode coupled to the second node, a first capacitor including the first electrode coupled to the first node and the second electrode coupled to an initialization line, a second capacitor including the first electrode coupled to the third node and the second electrode coupled to a data line, and a light-emitting diode including the anode coupled to the second node and the cathode coupled to a second power line. During a first period, a scan signal applied to the scan line has a turn-on level, a control voltage applied to the control line has a turn-on level, and an initialization voltage applied to the initialization line has a low level. A first power voltage applied to the first power line in the first period is higher than a second power voltage applied to the second power line in the emission period of the light-emitting diode.

In an exemplary embodiment, during a second period, the scan signal may have a turn-off level, the control voltage may have a turn-off level, and the initialization voltage may have the low level. The first power voltage in the second period may be lower than the first power voltage in the first period.

In an exemplary embodiment, the first power voltage in the second period may be equal to the second power voltage in the emission period.

In an exemplary embodiment, the second power voltage in the first period may be lower than the first power voltage in the emission period.

In an exemplary embodiment, a frame period may sequentially include the first period, the second period, and the emission period.

In an exemplary embodiment, the display device further includes scan lines, pixels of the plurality of pixels may be coupled to the scan lines, and the emission periods of the plurality of pixels may be the same as each other.

In an exemplary embodiment, during a third period before the first period within a frame period, the scan signal may have a turn-off level, the control voltage may have the turn-off level, and the initialization voltage may have the low level.

In an exemplary embodiment, in a period between the third period and the first period, the initialization voltage may have a high level.

In an exemplary embodiment, within the frame period, the first power voltage in a fourth period between the first period and the second period may be higher than the first power voltage in the first period and the second period.

In an exemplary embodiment, within the frame period, data voltages may be sequentially applied to the data line in a fifth period between the fourth period and the second period.

An exemplary embodiment of the invention provides a method of driving a display device including pixels, which include different light-emitting diodes, are commonly coupled to an initialization line, a control line, a first power line, and a second power line, and are coupled to different scan lines. The method includes, during a first period, supplying scan signals having a turn-on level to the scan lines, supplying a control voltage having a turn-on level to the control line, and supplying an initialization voltage having a low level to the initialization line, and allowing the light-emitting diodes to emit light during an emission period. A first power voltage applied to the first power line in the first period is higher than a second power voltage applied to the second power line in the emission period.

In an exemplary embodiment, the method may further include, during a second period, supplying the scan signals having a turn-off level, supplying the control voltage having a turn-off level, and supplying the initialization voltage having the low level. The first power voltage in the second period may be lower than the first power voltage in the first period.

In an exemplary embodiment, the first power voltage in the second period may be equal to the second power voltage in the emission period.

In an exemplary embodiment, the second power voltage in the first period may be lower than the first power voltage in the emission period.

In an exemplary embodiment, a frame period may sequentially include the first period, the second period, and the emission period.

In an exemplary embodiment, the pixels may be coupled to the same data line.

In an exemplary embodiment, the method may further include, during a third period before the first period within a frame period, supplying the scan signals having the turn-off level, supplying the control voltage having the turn-off level, and supplying the initialization voltage having the low level.

In an exemplary embodiment, the method may further include supplying the initialization voltage having a high level in a period between the third period and the first period.

In an exemplary embodiment, within the frame period, the first power voltage in a fourth period between the first period and the second period may be higher than the first power voltage in the first period and the second period.

In an exemplary embodiment, the method may further include sequentially supplying data voltages to the data line in a fifth period between the fourth period and the second period within the frame period.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
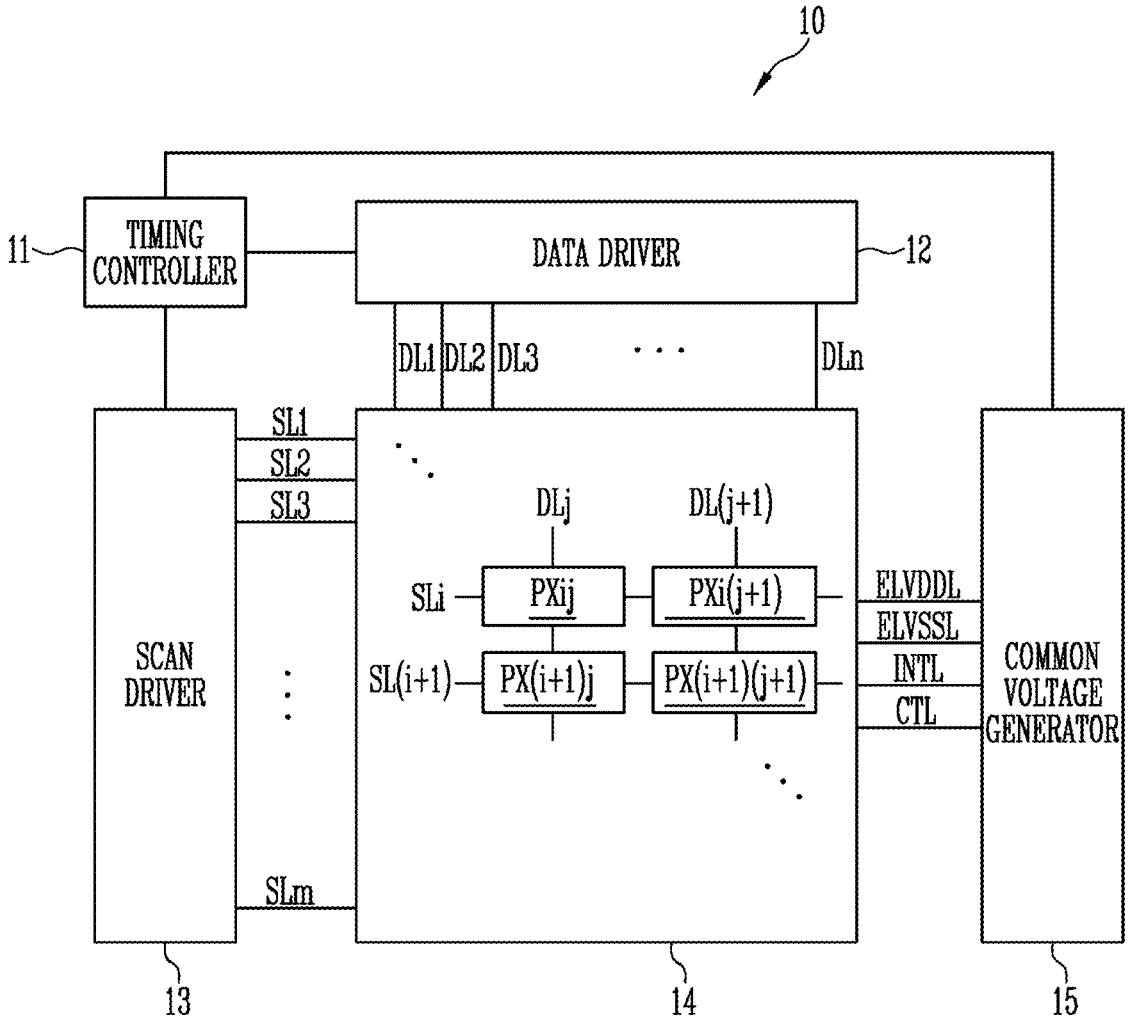
FIG. 1 is a diagram illustrating an exemplary embodiment of a display device according to the invention.

Hereinafter, exemplary embodiments of the invention will be described in detail with reference to the accompanying drawings so that those having ordinary knowledge in the technical field to which the invention pertains may easily practice the exemplary embodiments. The invention may be embodied in different forms and should not be construed as being limited to the exemplary embodiments set forth herein. Exemplary embodiments of the invention may be used by being combined with each other, or may be used individually.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

In order to clearly explain the invention, certain parts not relevant to the description are omitted, and like reference numerals denote like parts throughout this specification. Accordingly, previously used reference numerals may be used in different drawings.

Because the size and thickness of each configuration shown in the drawings are arbitrarily shown for better understanding and ease of description, the invention is not limited thereto. In the drawings, the thickness of layers and regions may be exaggerated for clarity.

FIG. 1 is a diagram illustrating an exemplary embodiment of a display device according to the invention.

Referring to FIG. 1, an exemplary embodiment of the display device 10 according to the invention may include a timing controller 11, a data driver 12, a scan driver 13, a pixel unit 14, and a common voltage generator 15.

The timing controller 11 may receive grayscale values for each image frame and control signals from an external processor. The timing control 11 may perform rendering on the grayscale values so as to correspond to the specification of the display device 10. In an exemplary embodiment, the external processor may supply a red grayscale value, a green grayscale value, and a blue grayscale value for each unit dot, for example. However, when the pixel unit 14 is in a pentile structure, because neighboring unit dots share a pixel, each grayscale value may not correspond to the pixel in a one-to-one manner. In this case, rendering of the grayscale values is desired. When each grayscale value corresponds to the pixel in a one-to-one manner, it may be unnecessary to perform rendering on the grayscale values. The grayscale values on which render is performed or not performed may be supplied to the data driver 12. Also, the timing controller 11 may supply the data driver 12, the scan driver 13, the common voltage generator 15, and the like with control signals suitable for the specification thereof in order to display an image frame.

The data driver 12 may generate data voltages to be supplied to data lines DL1, DL2, DL3, . . . , DLn using the grayscale values and control signals received from the timing controller 11. In an exemplary embodiment, the data driver 12 may sample the grayscale values using a clock signal and apply data voltages corresponding to the grayscale values to the data lines DL1, DL2, DL3, . . . , DLn in units of pixel rows, for example. Here, n may be an integer greater than 0.

The scan driver 13 receives control signals, such as a clock signal, a scan start signal, and the like, from the timing controller 11, thereby generating scan signals to be supplied to scan lines SL1, SL2, SL3, . . . , SLm. The scan driver 13 may select the pixels, to which data voltages are to be written, by supplying the scan signals through the scan lines SL1 to SLm. In an exemplary embodiment, the scan driver 13 may select a row of pixels, to which data voltages are to be written, by sequentially supplying scan signals having a turn-on level to the scan lines SL1 to SLm, for example. Here, m may be an integer greater than 0. Each stage circuit of the scan driver 13 may be configured in the form of a shift register, and may generate scan signals by sequentially transmitting a scan start signal to the next stage circuit under the control of a clock signal.

The pixel unit 14 may include pixels PXij, PXi(j+1), PX(i+1)j, and PX(i+1)(j+1). Each of the pixels may be coupled to a data line and a scan line corresponding thereto. In an exemplary embodiment, when data voltages for a single pixel row are applied to the data lines DL1 to DLn from the data driver 12, the data voltages may be written to the pixels in a row disposed in the scan line that receives a scan signal having a turn-on level from the scan driver 13, for example.

The pixels PXij and PXi(j+1) may be coupled to the same scan line SLi. The pixels PX(i+1)j, PX(i+1)(j+1) may be coupled to the same scan line SL(i+1). The pixels PXij and PX(i+1)j may be coupled to the same data line DLj. The pixels PXi(j+1) and PX(i+1)(j+1) may be coupled to the same data line DL(j+1). The pixels coupled to the same scan line may be expressed as being disposed in the same pixel row. The pixels coupled to the same data line may be expressed as being disposed in the same pixel column. Here, each of i and j may be an integer greater than 0.

In the illustrated exemplary embodiment, the emission periods of the pixels PXij, PXi(j+1), PX(i+1)j, and PX(i+1)(j+1) of the pixel unit 14 may be the same as each other. For the convenience of description, the display period of a black grayscale is also represented as an emission period.

The common voltage generator 15 may generate common voltages that are applied in common to the pixels PXij, PXi(j+1), PX(i+1)j, and PX(i+1)(j+1) of the pixel unit 14.

In an exemplary embodiment, the common voltage generator 15 may supply a first power voltage through a first power line ELVDDL, supply a second power voltage through a second power line ELVSSL, supply an initialization voltage through an initialization line INTL, and supply a control voltage through a control line CTL, for example.

The common voltage generator 15 may be implemented in various forms. In an exemplary embodiment, the common voltage generator 15 may be implemented in such a way that a part or the entire thereof is integrated with the data driver 12, for example. In another exemplary embodiment, the common voltage generator 15 may be implemented in such a way that a part or the entire thereof is integrated with the timing controller 11. In another exemplary embodiment, the common voltage generator 15 may be implemented in such a way that a part or the entire thereof is integrated with the timing controller 11 and the data driver 12. Also, the common voltage generator 15 may be implemented as a separate integrated chip ("IC").

Figure 2:
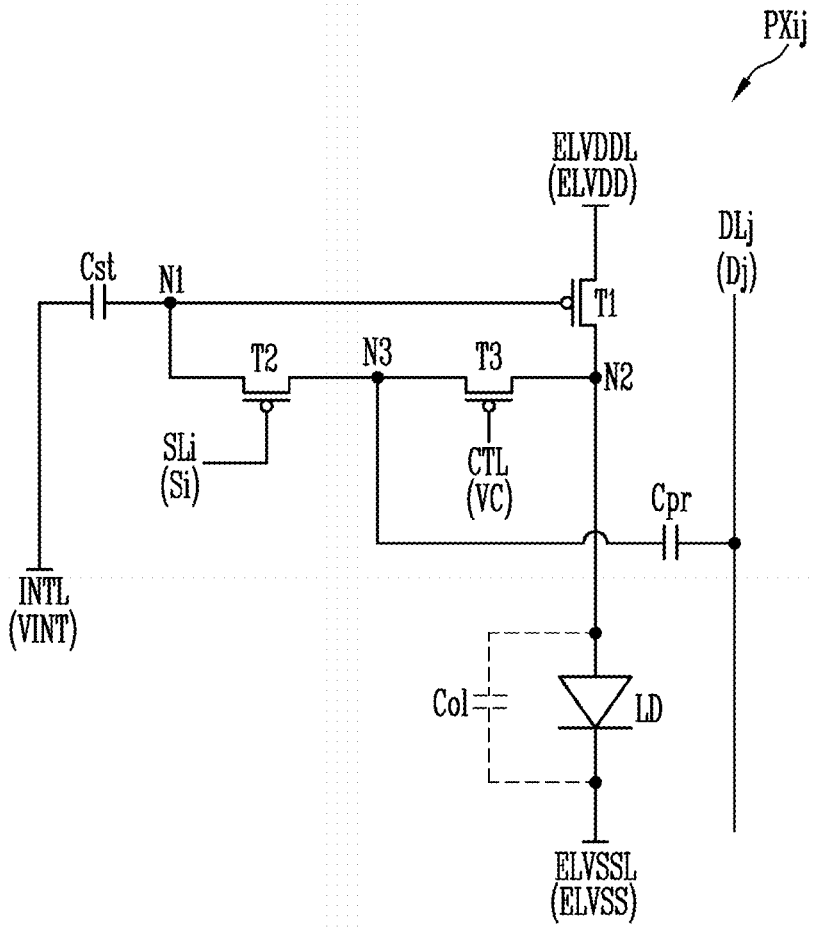
FIG. 2 is a diagram illustrating an exemplary embodiment of a pixel according to the invention.

FIG. 2 is a diagram illustrating an exemplary embodiment of a pixel according to the invention.

Referring to FIG. 2, an exemplary embodiment of a pixel PXij according to the invention may include first to third transistors T1, T2 and T3, first and second capacitors Cst and Cpr, and a light-emitting diode LD. The other pixels PXi(j+1), PX(i+1)j, and PX(i+1)(j+1) of FIG. 1 have the same configuration as the pixel PXij except for a coupling relationship with a data line and a scan line, and thus a repeated description will be omitted.

In the illustrated exemplary embodiment, the transistors T1, T2 and T3 are illustrated as P-type transistors. Accordingly, when the voltage applied to the gate electrode of the transistor has a low level, the level may be referred to as a turn-on level, and when it has a high level, the level may be referred to as a turn-off level. Those who skilled in the art may implement the illustrated exemplary embodiment by changing at least some of the transistors T1, T2 and T3 to N-type transistors.

The first transistor T1 may be configured such that the gate electrode thereof is coupled to a first node N1, the first electrode thereof is coupled to a first power line ELVDDL, and the second electrode thereof is coupled to a second node N2. The first transistor T1 may be also referred to as a driving transistor.

The second transistor T2 may be configured such that the gate electrode thereof is coupled to a scan line SLi, the first electrode thereof is coupled to the first node N1, and the second electrode thereof is coupled to a third node N3. The second transistor T2 may be also referred to as a scan transistor.

The third transistor T3 may be configured such that the gate electrode thereof is coupled to a control line CTL, the first electrode thereof is coupled to the third node N3, and the second electrode thereof is coupled to the second node N2. The third transistor T3 may be also referred to as an initialization transistor.

The first capacitor Cst may be configured such that the first electrode thereof is coupled to the first node N1 and the second electrode thereof is coupled to an initialization line INTL. The first capacitor Cst may be also referred to as a storage capacitor.

The second capacitor Cpr may be configured such that the first electrode thereof is coupled to the third node N3 and the second electrode thereof is coupled to a data line DLj.

The light-emitting diode LD may be configured such that the anode thereof is coupled to the second node N2 and the cathode thereof is coupled to the second power line ELVSSL. In an exemplary embodiment, the light-emitting diode LD may include an organic light-emitting diode, an inorganic light-emitting diode, a quantum dot light-emitting diode, or the like, for example. In an exemplary embodiment, the light-emitting diode LD may include a plurality of sub-light-emitting diodes coupled in serial or parallel.

The light-emitting diode LD emits light when the voltage difference between the anode and cathode thereof is equal to or higher than a predetermined level. However, because the anode and the cathode act like a kind of capacitor, the voltage of the anode is not immediately changed. Therefore, in order to describe the time at which the light-emitting diode LD emits light in detail, the capacitance Col of the light-emitting diode LD is illustrated.

A first power voltage ELVDD may be applied to the first power line ELVDDL, a second power voltage ELVSS may be applied to the second power line ELVSSL, an initialization voltage VINT may be applied to the initialization line INTL, a control voltage VC may be applied to the control line CTL, a scan signal Si may be applied to the scan line SLi, and a data voltage Dj may be applied to the data line DLj.

A driving current path may include the first power line ELVDDL, the first and second electrodes of the first transistor T1, the anode and cathode of the light-emitting diode LD, and the second power line ELVSSL. When a driving current equal to or higher than a predetermined level flows in the driving current path, the capacitance Col of the light-emitting diode LD is charged, whereby the light-emitting diode LD may emit light.

Figure 3:
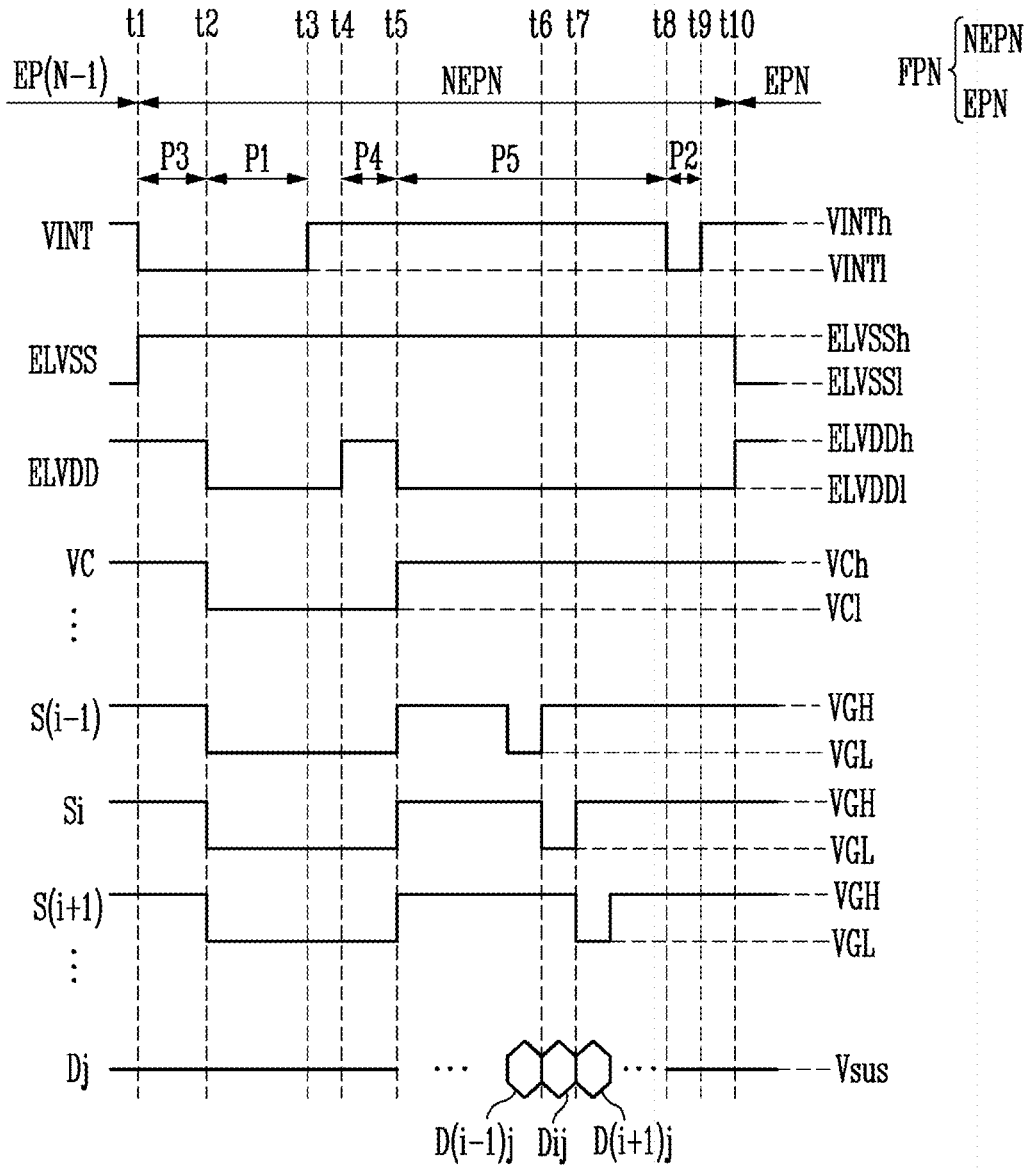
FIG. 3 is a diagram illustrating an exemplary embodiment of a method of driving the pixel of FIG. 2.
Figure 4:
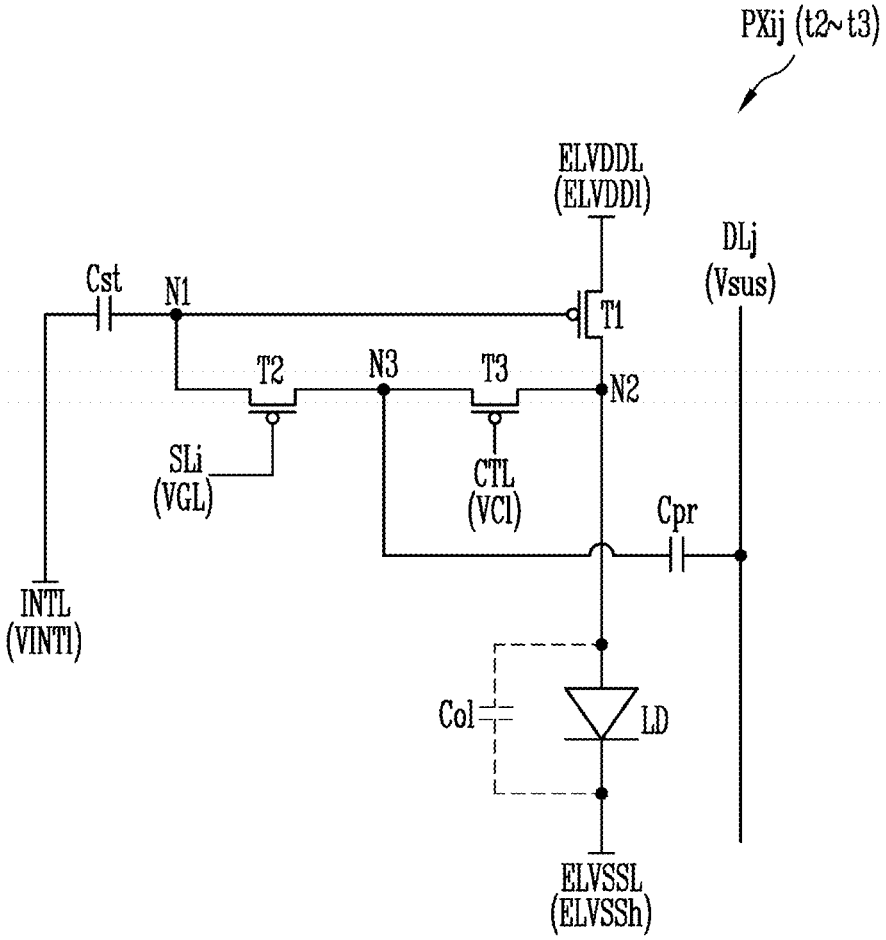
FIGS. 4 and 5 are diagrams illustrating an exemplary embodiment of a method of driving a pixel in a first period according to the invention.
Figure 5:
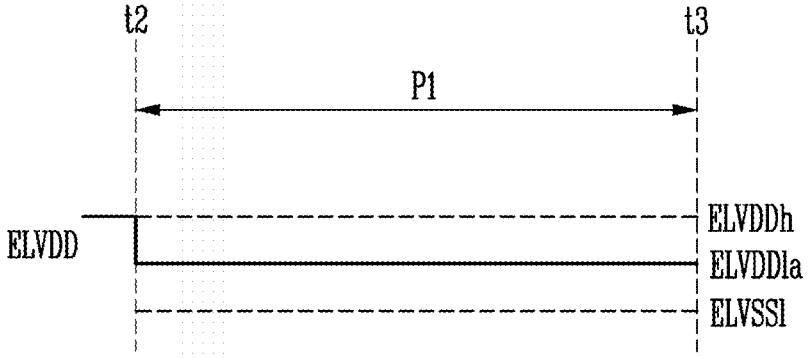
Figure 6:
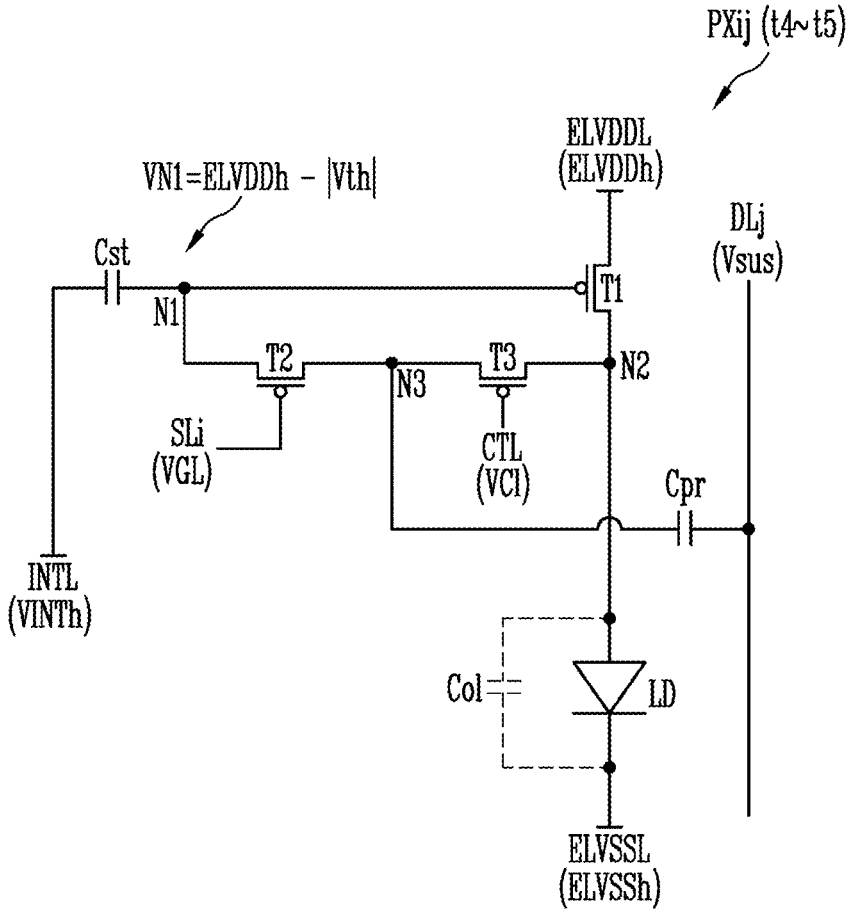
FIGS. 6 and 7 are diagrams illustrating an exemplary embodiment of a method of driving a pixel in fourth and fifth periods according to the invention.
Figure 7:
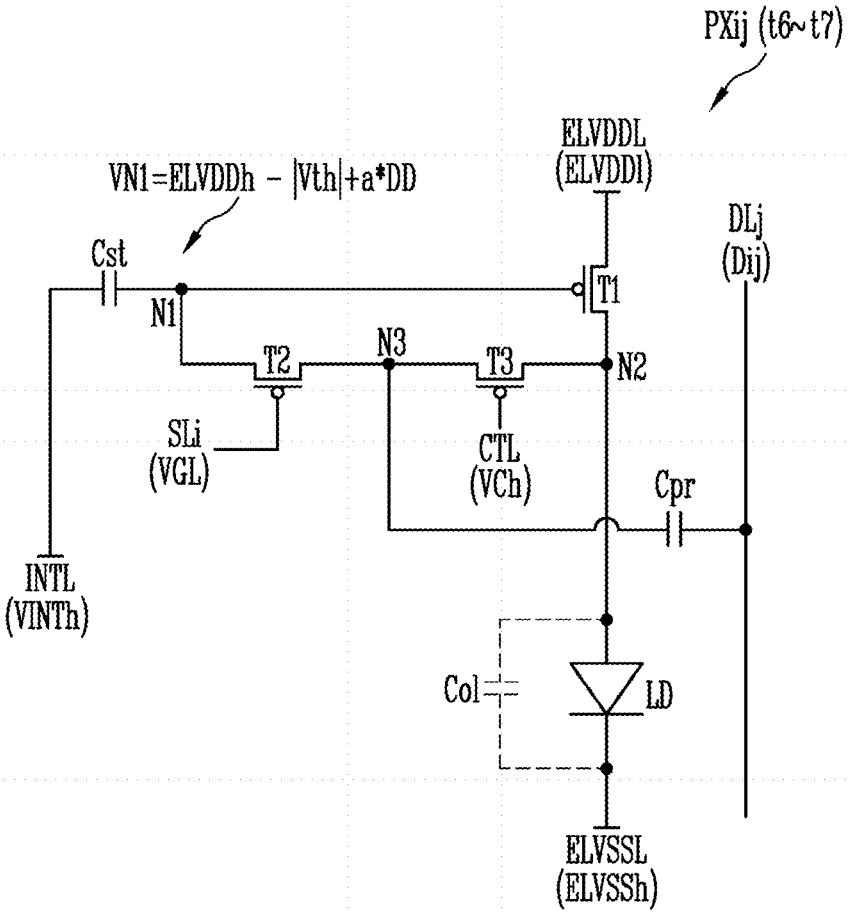
Figure 8:
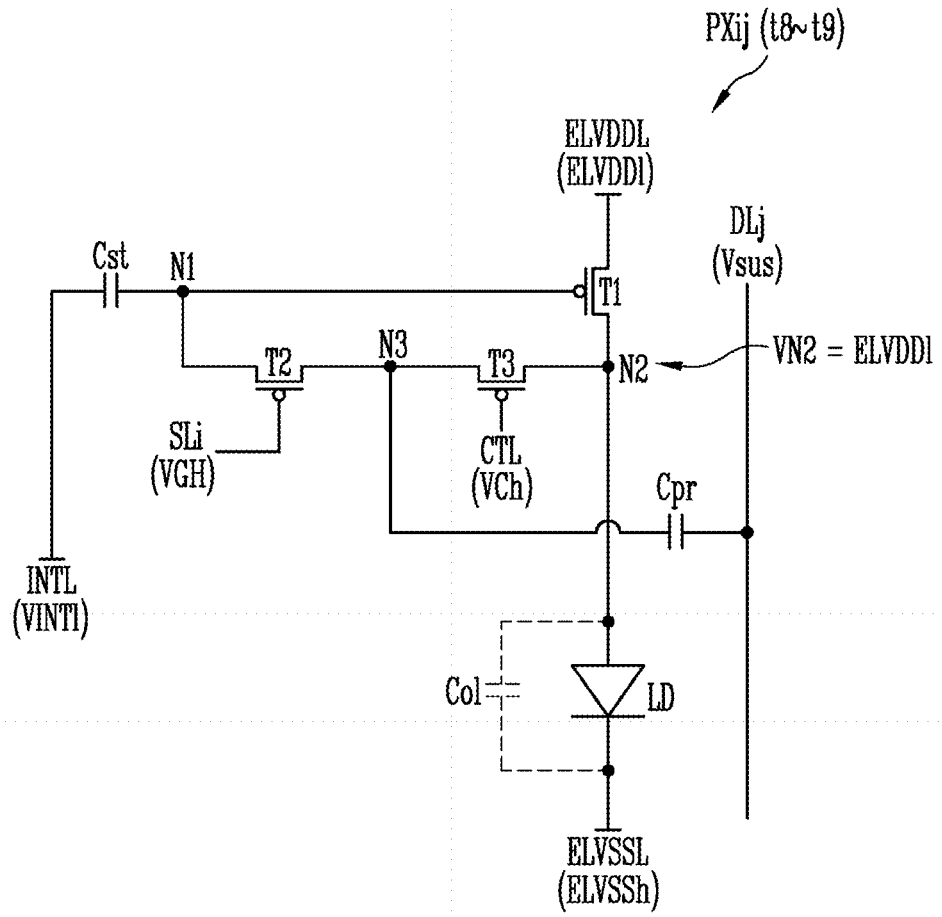
FIGS. 8 and 9 are diagrams illustrating an exemplary embodiment of a method of driving a pixel in a second period according to the invention.
Figure 9:
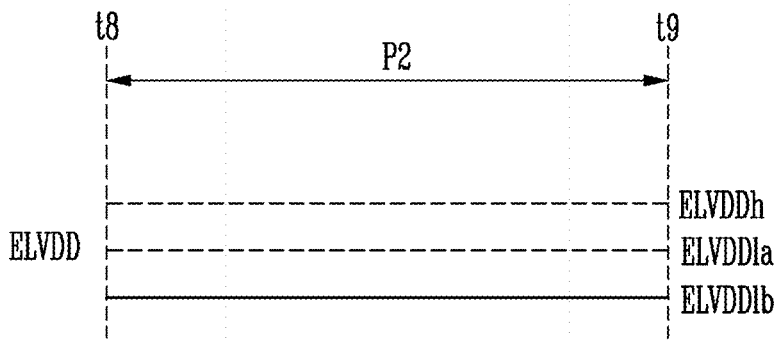
Figure 10:
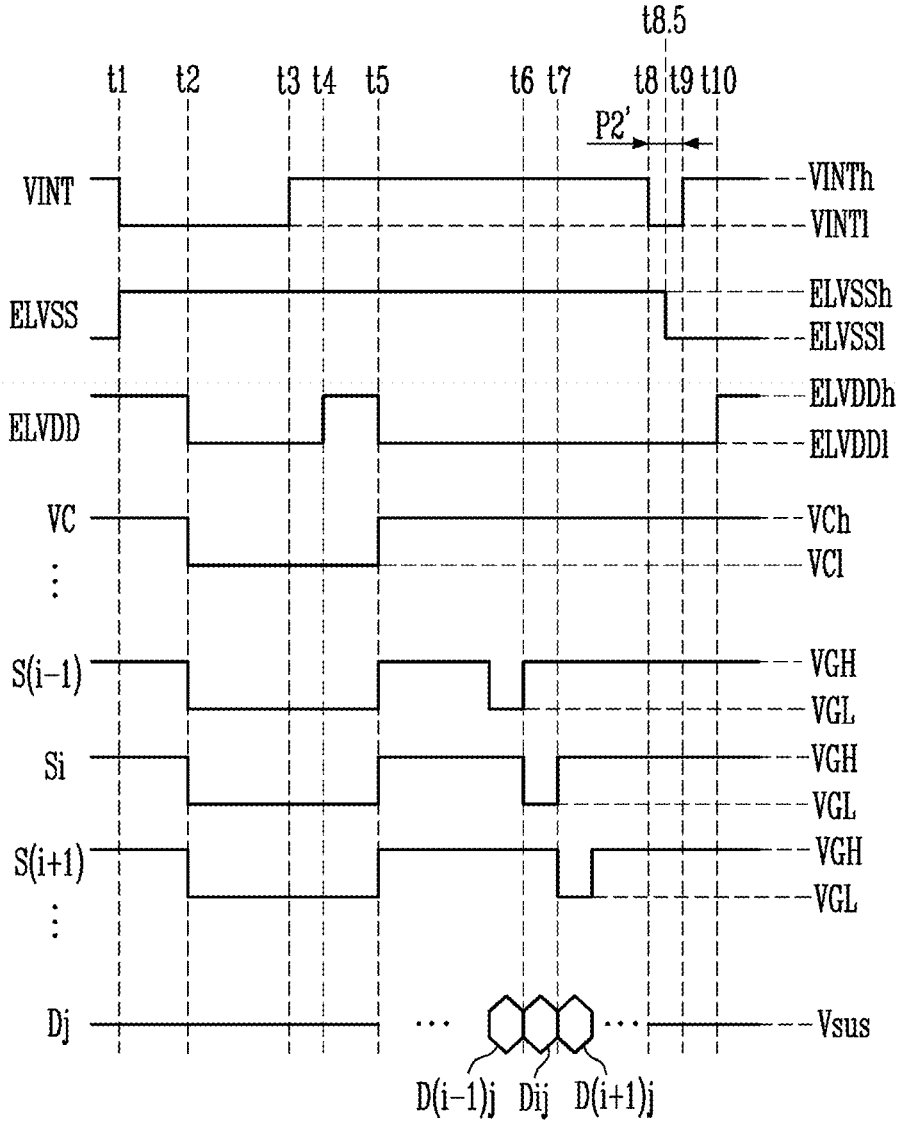
FIGS. 10 and 11 are diagrams illustrating a method of driving a pixel in a second period according to FIG. 3 and another exemplary embodiment of the invention.
Figure 11:
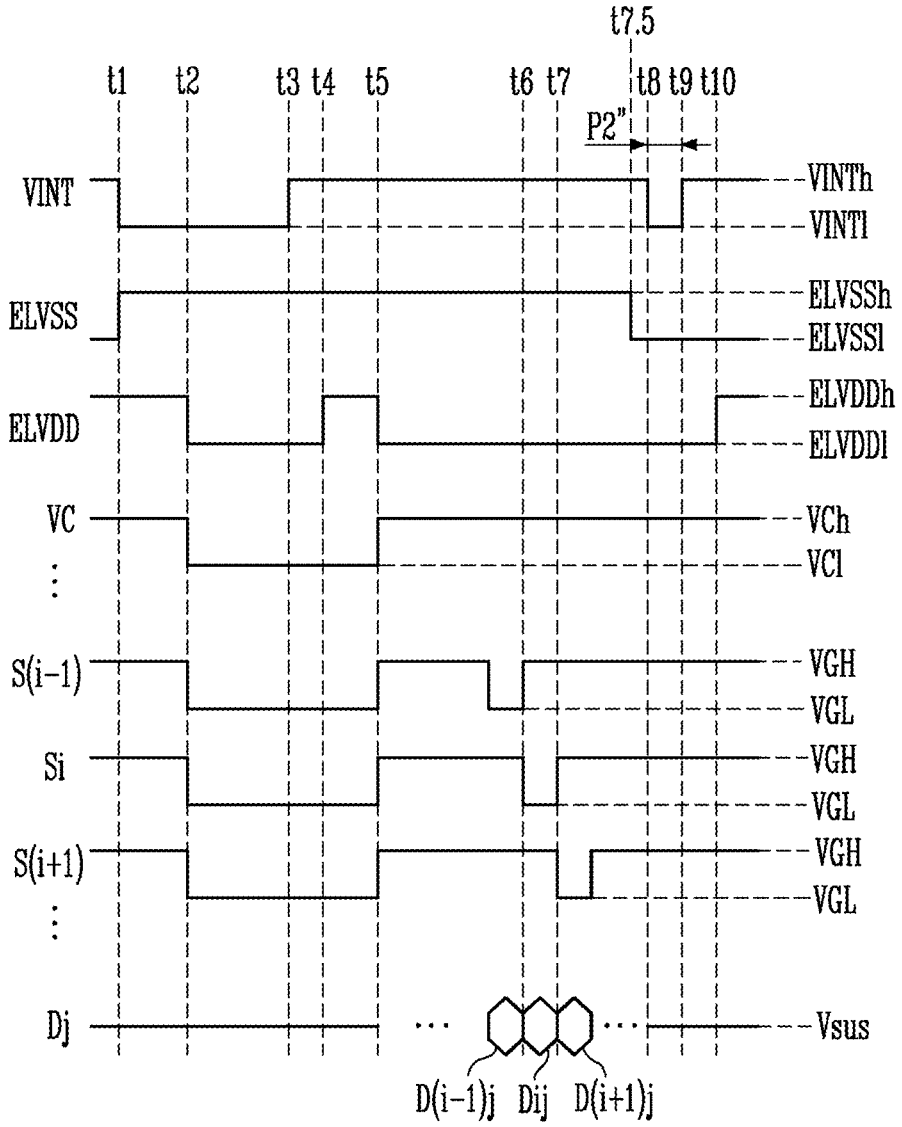

FIG. 3 is a diagram illustrating a method of driving the pixel of FIG. 2. FIGS. 4 and 5 are diagrams illustrating an exemplary embodiment of a method of driving a pixel in a first period according to the invention. FIGS. 6 and 7 are diagrams illustrating an exemplary embodiment of a method of driving a pixel in fourth and fifth periods according to the invention. FIGS. 8 and 9 are diagrams illustrating an exemplary embodiment of a method of driving a pixel in a second period according to the invention. FIGS. 10 and 11 are diagrams illustrating a method of driving a pixel in the second period according to FIG. 3 and another exemplary embodiment of the invention.

At the time point t1, the second power voltage ELVSS may rise from a low level ELVSSl to a high level ELVSSh, and the initialization voltage VINT may drop from a high level VINTh to a low level VINTl. At this time, the first power voltage ELVDD may maintain a high level ELVDDh. Also, the control voltage VC and the scan signals S(i−1), Si, and S(i+1) may maintain a turn-off level VCh or VGH.

Accordingly, the voltage difference between the anode and cathode of the light-emitting diode LD is not sufficient, whereby light emission by the light-emitting diode LD depending on the grayscale of the previous image frame is terminated. That is, the emission period EP(N−1) of the previous frame period is terminated. Also, because the voltage of the first node N1 decreases due to coupling by the first capacitor Cst, an on-biased voltage is applied to the first transistor T1. Accordingly, the hysteresis issue of the first transistor T1 may be alleviated. That is, the first transistor T1 may have a consistent characteristic for the current to the gate-source voltage, regardless of the data voltage of the previous image frame.

The period from the time point t1 to the time point t2, that is, the third period P3, may be also referred to as an on-bias period. During the third period P3 before the first period P1 within a frame period FPN, the scan signals S(i−1), Si, and S(i+1) may have a turn-off level VGH, the control voltage VC may have the turn-off level VCh, and the initialization voltage VINT may have the low level VINTl.

At the time point t2, the first power voltage ELVDD may drop from the high level ELVDDh to a low level ELVDDl, the control voltage VC may drop from the turn-off level VCh to a turn-on level VCl, and the voltage levels of the scan signals S(i−1), Si, and S(i+1) may drop from the turn-off level VGH to a turn-on level VGL.

Accordingly, the second transistor T2 and the third transistor T3 are turned on, and the voltages of the first to third nodes N1, N2 and N3 may be initialized. The electric charge accumulated in the first to third nodes N1, N2 and N3 may be discharged (leakage current) to the first power line ELVDDL through the first transistor T1. Accordingly, at the time point t3, the voltages of the first to third nodes N1, N2 and N3 may approximately converge to the first power voltage ELVDD. Here, a reverse biased voltage is applied to the light-emitting diode LD, whereby the light-emitting diode LD does not emit light (reference to FIG. 4).

The period from the time point t2 to the time point t3, that is, the first period P1, may be also referred to as an initialization period. During the first period P1, the scan signals S(i−1), Si and S(i+1) applied to the scan lines may have the turn-on level VGL, the control voltage VC applied to the control line CTL may have the turn-on level VCl, and the initialization voltage VINT applied to the initialization line INTL may have the low level VINTl.

In order to turn on the second transistor T2 and the third transistor T3 in the initialization period, it is necessary to apply the voltage lower than the voltage of the first to third nodes N1, N2 and N3 to the gate electrodes of the second transistor T2 and the third transistor T3. That is, during the initialization period, the scan driver 13 needs to supply the scan signals S(i−1), Si, and S(i+1) having the level lower than the low level ELVDDl of the first power voltage ELVDD. Also, during the initialization period, the common voltage generator 15 needs to supply the control voltage VC having the level lower than the low level ELVDDl of the first power voltage ELVDD. Accordingly, a reliability problem of the scan driver 13 and the common voltage generator 15 may be caused due to a voltage stress.

In an exemplary embodiment of the invention, the voltage level ELVDDla of the first power voltage ELVDD applied to the first power line ELVDDL in the first period P1 may be higher than the voltage level ELVSSl of the second power voltage ELVSS applied to the second power line ELVSSL in the emission period EPN of the light-emitting diode LD (reference to FIG. 5).

Because the conventional art uses a single voltage source for a low level, the low level of the first power voltage ELVDD is equal to the low level of the second power voltage ELVSS. According to the illustrated exemplary embodiment, the low level of the first power voltage ELVDD and the low level of the second power voltage ELVSS may be supplied individually, and may differ from each other.

According to the illustrated exemplary embodiment, even though the turn-on level VGL of the scan signal Si to be applied to the gate electrode of the second transistor T2 becomes higher than that in the conventional art, the second transistor T2 may be turned on. Accordingly, the scan driver 13 does not have to generate scan signals S(i−1), Si, and S(i+1) having an excessively low level, whereby the voltage stress of the scan driver 13 may be reduced and the lifespan of the scan driver 13 may be improved.

Similarly, even though the turn-on level VCl of the control voltage VC to be applied to the gate electrode of the third transistor T3 becomes higher than that in the conventional art, the third transistor T3 may be turned on. Accordingly, the common voltage generator 15 does not have to generate a control voltage VC having an excessively low level, whereby the voltage stress of the common voltage generator 15 may be reduced and the lifespan of the common voltage generator 15 may be improved.

At the time point t4, the first power voltage ELVDD may rise from the low level ELVDDl to the high level ELVDDh.

Referring to FIG. 6, the first to third nodes N1, N2 and N3 may be coupled to each other through the second transistor T2 and the third transistor T3 that are turned on. Accordingly, the first transistor T1 is diode-coupled. Because the first transistor T1 is in the diode-coupled state, a voltage VN1 reduced by the threshold voltage |Vth| of the first transistor T1 from the first power voltage ELVDD having the high level ELVDDh may be applied to the first node N1.

The period from the time point t4 to the time point t5, that is, the fourth period P4, may be also referred to as a threshold voltage compensation period. The first power voltage ELVDD in the fourth period P4 between the first period P1 and the second period P2 within a frame period FPN may be higher than the first power voltage ELVDD in the first period P1 and the second period P2.

The period from the time point t5 to the time point t8, that is, the fifth period P5, may be also referred to as a data-writing period. In the fifth period P5 between the fourth period P4 and the second period P2 within a frame period FPN, data voltages D(i−1)j, Dij, and D(i+1)j may be sequentially applied to the data line DLj.

In the data-writing period, the scan driver 13 may sequentially apply the scan signals S(i−1), Si, and S(i+1) having the turn-on level VGL to the scan lines. In an exemplary embodiment, the scan driver 13 may apply the scan signals S(i−1), Si, and S(i+1) having the turn-on level VGL to the respective scan lines at an interval of one horizontal period, for example.

Also, the data driver 12 may sequentially apply the data voltages D(i−1)j, Dij, and D(i+1)j to the data line DLj by being synchronized with the scan driver 13.

For the convenience of description, the period from t6 to t7 during which the data voltage Dij and the scan signal Si having the turn-on level VGL are applied to the pixel PXij is described (reference to FIG. 7).

The voltage Dj of the data line DLj is changed from a reference voltage Vsus to the data voltage Dij at the time point t6 within the fifth period P5 when it is compared with the fourth period P4. Here, because the second transistor T2 is in a turn-on state and because the third transistor T3 is in a turn-off state, the first capacitor Cst and the second capacitor Cpr may be coupled in serial between the data line DLj and the initialization line INTL.

Accordingly, the first node voltage VN1 at the time point t7 may have a value to which the voltage difference DD between the data voltage Dij and the reference voltage Vsus based on the capacitance ratio (a) of the first capacitor Cst and the second capacitor Cpr is further reflected, when it is compared with the first node voltage VN1 in the fourth period P4 (reference to the following Equations (1) to (3) and FIG. 7).

$$DD=Dij-Vsus \tag{1}$$

$$a=CprF/(CstF+CprF) \tag{2}$$

$$VN1=ELVDDh-|Vth|+a*DD \tag{3}$$

Here, CstF denotes the capacitance of the first capacitor Cst, and CprF denotes the capacitance of the second capacitor Cpr.

At the time point t8, the initialization voltage VINT may drop to the low level VINTl. The period from the time point t8 to the time point t9, that is, the second period P2, may be also referred to as a bypass period. During the second period P2, the scan signals S(i−1), Si, and S(i+1) may have the turn-off level VGH, the control voltage VC may have the turn-off level VCh, and the initialization voltage VINT may have the low level VINTl.

Referring to FIG. 8, because the initialization voltage VINT drops to the low level VINTl, the voltage of the first node N1 also drops due to coupling of the first capacitor Cst. Accordingly, the first transistor T1 is turned on, and the electric charges accumulated in the second node N2 may be discharged to the first power line ELVDDL through the first transistor T1 so that a voltage VN2 of the second node N2 may have the low level ELVDDl. Accordingly, the capacitance Col of the light-emitting diode LD is initialized, whereby representation of a black grayscale or a low grayscale may be improved.

According to the illustrated exemplary embodiment, the voltage level ELVDDlb of the first power voltage ELVDD in the second period P2 may be lower than the voltage level ELVDDla of the first power voltage ELVDD in the first period P1 (reference to FIGS. 5 and 9). In an exemplary embodiment, the voltage level ELVDDlb of the first power voltage ELVDD in the second period P2 may be equal to the voltage level ELVSSl of the second power voltage ELVSS in the emission period EPN, for example.

If the voltage level of the first power voltage ELVDD in the second period P2 is higher than the voltage level ELVSSl of the second power voltage ELVSS in the emission period EPN (the case in which the threshold voltage of the light-emitting diode LD is ignored), a forward-direction voltage is applied to the light-emitting diode LD when the second power voltage ELVSS drops to the low level ELVSSl (at t10 in FIG. 3, t8.5 in FIG. 10, and t7.5 in FIG. 11), whereby a flash may be caused, which is undesirable.

Referring to FIG. 3, the second power voltage ELVSS in the second period P2 is illustrated as having the high level ELVSSh. However, in the second period P2, the second power voltage ELVSS is good enough when it is not lower than the first power voltage ELVDD. In an exemplary embodiment, the second power voltage ELVSS may have the high level ELVSSh or the low level ELVSSl. Referring to FIG. 10, at the time point t8.5 within the second period P2', the second power voltage ELVSS may drop to the low level ELVSSl. Referring to FIG. 11, at the time point t7.5 before the second period P2", the second power voltage ELVSS may drop to the low level ELVSSl. However, in the exemplary embodiment of FIG. 11, it is desirable for the data-writing period to be terminated before the time point t7.5 in order to prevent data from being wrongly written due to coupling.

At the time point t10, the first power voltage ELVDD may be changed from the low level ELVDDl to the high level ELVDDh, and the second power voltage ELVSS may be changed from the high level ELVSSh to the low level ELVSSl. Accordingly, a forward-direction voltage may be applied to the light-emitting diode LD, whereby the driving current path is enabled. Here, the amount of driving current flowing through the first transistor T1 may be determined based on the voltage stored in the first node N1. The light-emitting diode LD may emit light with luminance corresponding to the amount of the driving current.

Each frame period FPN may include a non-emission period NEPN and an emission period EPN. The emission period EP(N−1) indicates the emission period of the previous frame period. Each frame period FPN may sequentially include the first period P1, the second period P2, and the emission period EPN. Each frame period FPN may sequentially include the third period P3, the first period P1, the fourth period P4, the fifth period P5, the second period P2, and the emission period EPN.

The time point t10 may be the emission start point of the emission period EPN of the current frame period FPN. The time point t1 of the next frame period may be the emission end point of the emission period EPN.

Figure 12:
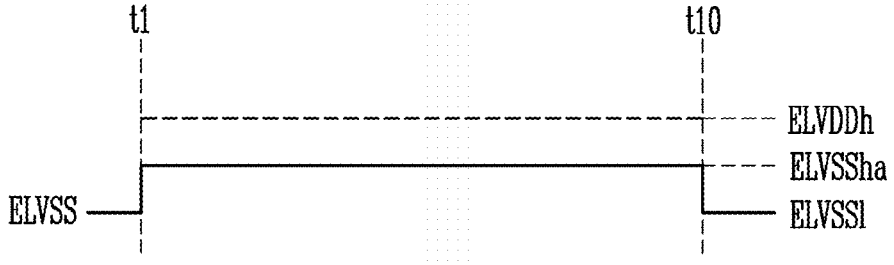
FIG. 12 is a diagram for explaining an exemplary embodiment of the magnitude of a second power voltage according to the invention.

FIG. 12 is a diagram for explaining an exemplary embodiment of the magnitude of a second power voltage according to the invention.

Referring to FIG. 12, the voltage level ELVSSha of the second power voltage ELVSS in the period from t1 to t10 may be lower than the voltage level ELVDDh of the first power voltage ELVDD in the emission period EPN.

Because the convention art uses a single voltage source for a high level, the high level of the first power voltage ELVDD is equal to the high level of the second power voltage ELVSS. According to the illustrated exemplary embodiment, the high level of the first power voltage ELVDD and the high level of the second power voltage ELVSS may be supplied individually, and may differ from each other.

The voltage level ELVDDh of the first power voltage ELVDD in the emission period EPN is very high because it is set in consideration of a voltage ("IR") drop. Therefore, when the high level ELVSSh of the second power voltage ELVSS is set equal to this voltage level, an excessive reverse voltage is imposed on the light-emitting diode LD, whereby undesired reverse-direction current flows or the light-emitting diode LD may be easily deteriorated. In the exemplary embodiment of FIG. 12, these problems may be solved.

Figure 13:
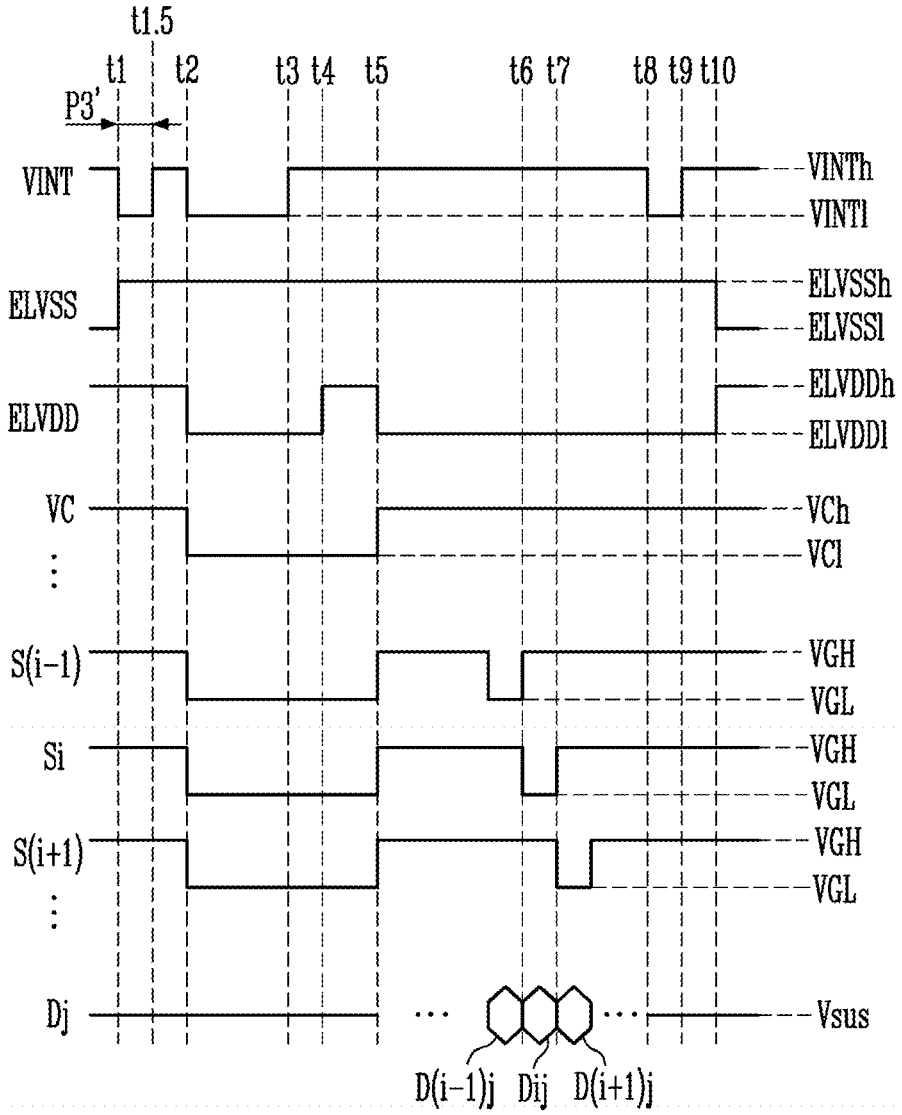
FIGS. 13 and 14 are diagrams illustrating another exemplary embodiment of a method of driving a pixel in a third period according to the invention.
Figure 14:
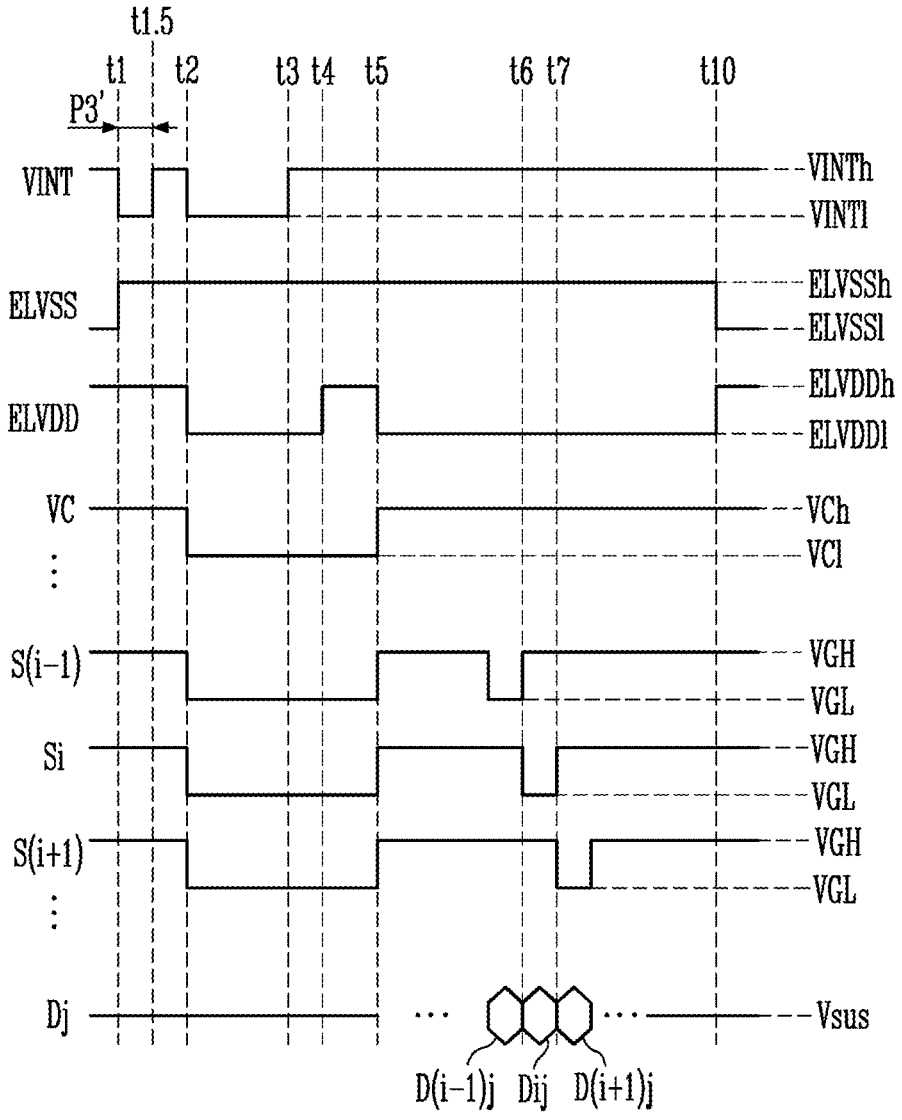

FIGS. 13 and 14 are diagrams illustrating an exemplary embodiment of a method of driving a pixel in a third period according to the invention.

Referring to FIGS. 13 and 14, in the period from t1.5 to t2, which is between third period P3' and the first period from t2 to t3, the initialization voltage VINT may have a high level VINTh.

In the exemplary embodiment of FIGS. 13 and 14, the third period P3' may be defined as the period between the time point t1 and the time point t1.5. According to the illustrated exemplary embodiment, the on-bias period from t1 to t1.5 may be clearly differentiated from the initialization period from t2 to t3.

A display device and a method of driving the display device according to the invention may simultaneously solve both the IR drop problem and a reliability problem with control circuits.

The drawings and the detailed description of the invention are examples for the invention and are provided for illustrative purpose, rather than limiting the scope of the invention described in the claims. Therefore, it will be appreciated to those skilled in the art that various modifications may be made and other exemplary embodiments are available. Accordingly, the scope of the invention should be determined by the spirit and scope of the appended claims.

What is claimed is:

1. A display device, comprising:

a plurality of pixels, each of the plurality of pixels including a first transistor comprising a gate electrode coupled to a first node, a first electrode coupled to a first power line, and a second electrode coupled to a second node;

a second transistor comprising a gate electrode coupled to a scan line, a first electrode coupled to the first node, and a second electrode coupled to a third node;

a third transistor comprising a gate electrode coupled to a control line, a first electrode coupled to the third node, and a second electrode coupled to the second node;

a first capacitor comprising a first electrode coupled to the first node and a second electrode coupled to an initialization line;

a second capacitor comprising a first electrode coupled to the third node and a second electrode coupled to a data line; and a light-emitting diode comprising an anode coupled to the second node and a cathode coupled to a second power line, wherein during a first period, a scan signal applied to the scan line has a turn-on level, a control voltage applied to the control line has a turn-on level, and an initialization voltage applied to the initialization line has a low level, wherein a first power voltage applied to the first power line in the first period is higher than a second power voltage applied to the second power line in an emission period of the light-emitting diode, and wherein, during a third period before the first period within a frame period, the scan signal has a turn-off level, the control voltage has the turn-off level, and the initialization voltage has the low level.

2. The display device according to claim 1, wherein:

during a second period, the scan signal has a turn-off level, the control voltage has a turn-off level, and the initialization voltage has the low level, and the first power voltage in the second period is lower than the first power voltage in the first period.

3. The display device according to claim 2, wherein the first power voltage in the second period is equal to the second power voltage in the emission period.

4. The display device according to claim 2, wherein a frame period sequentially includes the first period, the second period, and the emission period.

5. The display device according to claim 1, wherein the second power voltage in the first period is lower than the first power voltage in the emission period.

6. The display device according to claim 1, further comprising scan lines, wherein:

pixels of the plurality of pixels are coupled to the scan lines, and emission periods of the plurality of pixels are identical to each other.

7. The display device according to claim 1, wherein, in a period between the third period and the first period, the initialization voltage has a high level.

8. The display device according to claim 1, wherein, within the frame period, the first power voltage in a fourth period between the first period and the second period is higher than the first power voltage in the first period and the second period.

9. The display device according to claim 8, wherein, within the frame period, data voltages are sequentially applied to the data line in a fifth period between the fourth period and the second period.

10. A method of driving a display device including pixels, which include different light-emitting diodes, are commonly coupled to an initialization line, a control line, a first power line, and a second power line, and are coupled to different scan lines, the method comprising:

during a third period within a frame period, supplying the scan having a turn-off level, supplying a control voltage having the turn-off level, and supplying an initialization voltage having a low level, during a first period after the third period, supplying scan signals having a turn-on level to the scan lines, supplying control voltage having the turn-on level to the control line, and supplying initialization voltage having the low level to the initialization line; and allowing the light-emitting diodes to emit light during an emission period, wherein a first power voltage applied to the first power line in the first period is higher than a second power voltage applied to the second power line in the emission period.

11. The method according to claim 10, further comprising:

during a second period, supplying the scan signals having a turn-off level, supplying the control voltage having a turn-off level, and supplying the initialization voltage having the low level, wherein the first power voltage in the second period is lower than the first power voltage in the first period.

12. The method according to claim 11, wherein the first power voltage in the second period is equal to the second power voltage in the emission period.

13. The method according to claim 11, wherein a frame period sequentially includes the first period, the second period, and the emission period.

14. The method according to claim 11, wherein the pixels are coupled to a same data line.

15. The method according to claim 10, wherein the second power voltage in the first period is lower than the first power voltage in the emission period.

16. The method according to claim 10, further comprising:

in a period between the third period and the first period, supplying the initialization voltage having a high level.

17. The method according to claim 10, wherein, within the frame period, the first power voltage in a fourth period between the first period and the second period is higher than the first power voltage in the first period and the second period.

18. The method according to claim 17, further comprising:

sequentially supplying data voltages to the data line in a fifth period between the fourth period and the second period within the frame period.

* * * * *